United States Patent [19]

Cohen

[11] Patent Number: 4,527,768

[45] Date of Patent: Jul. 9, 1985

[54] TIE ROD WITH SELF-SECURING END

[76] Inventor: Andrew S. Cohen, 13000 SW. 92nd Ave., Apt. B211, Miami, Fla. 33176

[21] Appl. No.: 530,721

[22] Filed: Sep. 9, 1983

[51] Int. Cl.[3] ..... E04G 17/08

[52] U.S. Cl. ..... 249/214; 249/41; 249/190; 249/216

[58] Field of Search ..... 249/213, 214, 216, 217, 249/40–43, 190, 191; 403/194, 197, 238, 239

[56] References Cited

U.S. PATENT DOCUMENTS

| | | | |
|---|---|---|---|
| 3,464,667 | 9/1969 | Sledz | 249/217 |
| 3,614,052 | 10/1971 | Babbage | 249/213 |
| 3,801,061 | 4/1974 | Holt | 249/217 |
| 3,905,093 | 9/1975 | Williams | 249/217 |
| 4,054,258 | 10/1977 | Holmboe | 249/217 |

*Primary Examiner*—Willard Hoag
*Assistant Examiner*—James C. Housel
*Attorney, Agent, or Firm*—Herman J. Hohauser

[57] ABSTRACT

A concrete form self securing tie rod is provided with a cone shaped element having a dowel-like extension slidably mounted on an elongated rod having formed thereon an integrally formed wedge portion. The dowel-like portion of the cone-shaped element has teeth that lockingly engages the element into an aperture formed in the panel making up one side of the concrete form to prevent vertical movement of the tie rod. The wedge shaped portion of the elongated rod lockingly engages the cone element to prevent horizontal movement of the tie rod.

8 Claims, 6 Drawing Figures

TIE ROD WITH SELF-SECURING END

BACKGROUND OF THE INVENTION

1. Field of the Invention

This invention relates to tie rods used in the errection of form walls for concrete construction. Specifically, tie rods space apart and secure two opposed form panels and are used in conjunction with rigid horizontal and vertical bracing attached to the form panels. After concrete has been poured and cured, the bracing and form panels are removed. Tie rods of the "snap tie" variety have their end portions twisted and broken off to allow for their extraction from the hardened concrete.

2. Description of the Prior Art

The prior art includes tie rods of various designs. U.S. Pat. No. 3,806,080 describes a form system utilizing cone flanges, form ties, and form locks. U.S. Pat. No. 4,027,847 describes a tie rod with an expandable element at one end for abutting engagement with the inner surfaces of a form wall. U.S. Pat. No. 3,901,061 describes a form construction using opposed panels, grouting cores, and tie rods. U.S. Pat. No. 3,841,600 describes a concrete form tie assembly utilizing anchor pins, wedges, spool like sleeve members, and a plurality of gripping teeth. U.S. Pat. No. 3,998,424 describes a tie rod with an expandable locking cone. U.S. Pat. No. 3,941,346 describes a tie rod assembly utilizing resilient sealing and spacing means.

As shown by the above cited U.S. patents, the securing of tie rods to one side of a form panel remains a labor intensive operation requiring at least two workers. One worker must be holding the tie rod in place while another worker secures the end of the rod from outside of the form.

Another drawback of conventional tie rods is the difficulty often encountered in removing portions of the form panel due to concrete seeping through the form panel apertures during the hardening of the concrete.

BRIEF DESCRIPTION OF THE INVENTION

The present invention employs a novel and labor-saving design for a tie rod including a rod on the surface of which is slidably mounted a cone shaped device formed with a dowel-like teeth bearing element. The teeth-bearing element is positioned in an aperture in the form panel so that by virtue of the tight engagement of the gripping teeth of the dowel-like bearing element in the form panel the tie rod is secured against vertical movement relative to the form panel. The tie rod is also structured to prevent its horizontal movement by virtue of a wedge-shaped enlargement formed as an integral part of the rod. When the rod is slidably projected through the cone shaped device so that the wedge shaped enlargement on the rod is lockingly engaged in an aperture formed in the cone-shaped device horizontal movement of the entire tie rod cannot occur.

Thus, this invention provides a tie rod structure that, as explained above, can be installed into a form panel so that both horizontal and vertical movement will not occur thereby enabling a working to place and subsequently secure the rod to the form panel without the need of a helper to hold the tie rod assembly in place.

This invention also provides a tie rod utilizing a cone shaped device having a stripping snap point which allows easy removal of the form panel even when concrete seepage through aperture in the panel has occurred.

This invention further provides a tie rod of the "snap tie" variety, formed with a rod snap point which enables the end portion of the tie rod to be bent, twisted, and broken off, allowing extraction of the end portion of the rod from the hardened concrete.

The inventive tie rod can be used with most conventional form panels and bracing systems and is economical and convenient to manufacture, transport, and use.

Other advantages of the invention will become apparent upon a close examination of the following drawings and descriptions.

DETAILED DESCRIPTION OF THE INVENTION

The self-securing tie rod is composed of a rod 2, a self securing cone element 4, and a cone 5 of conventional design.

Figure 1:
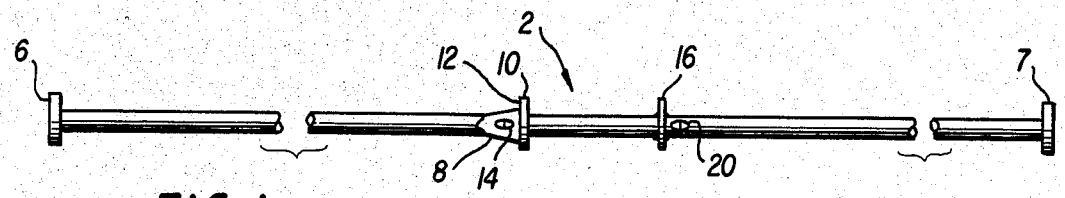
FIG. 1 is a side elevational view of the tie rod without the inventive cone element and conventional cone.

Referring to FIG. 1, rod 2 is shown for illustration purposes without cone element 4 and cone 5. It is to be understood that the cone element 4 and cone 5 are mounted on rod 2 before the ends of rod 2 are finally formed as will be explained in more detail below. In the preferred embodiment, rod 2 is manufactured from steel or some other suitable material. At the terminus of one end of rod 2 is a radially enlarged head 6, corresponding to a head 7 at the opposite end of rod 2. In the preferred embodiment cone element 4 and cone 5 are slidably received onto rod 2 prior to the formation of heads 6 and 7. Wedge 8 is formed as an integral part of rod 2 and is seen to have a steadily increasing diameter terminating at shoulder 10. Lip 12 defines the surface area adjacent wedge 8 parallel to and facing head 6. Rod snap point 14 is an indentation in wedge 8 resulting in a weakened area the use of which is explained in more detail below. Abutment 16 is located at a predetermined distance between shoulder 10 and head 7. Conventional rod snap point 20 is formed adjacent to abutment 16 as shown.

Figure 2:
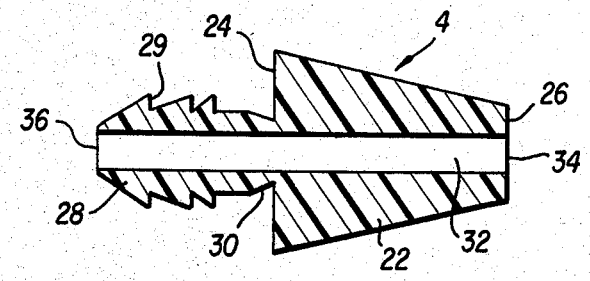
FIG. 2 is an elevational side cross section of the inventive cone element.

FIG. 2 shows a cross section of cone element 4, which in the preferred embodiment is molded from hard plastic or other suitable material. Conical portion 22 includes a base 24 parallel with opposite end 26. Protruding from base 24 is a dowel-like plug 28 having gripping teeth 29 formed on the surface thereof. Stripping snap point 30 is a weakened area formed on plug 28 as a result of a decreased diameter immediately adjacent to base 24. An axially centered cylindrically shaped bore 32 extends longitudinally through cone element 4 and defines aperture 34 at end 26 and aperture 36 of portion 28.

Figure 3:
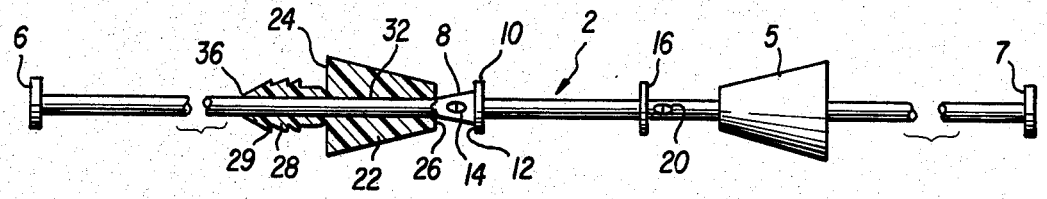
FIG. 3 is a elevational side view of the inventive cone element and the conventional cone mounted on the rod.

FIG. 3 shows the preferred embodiment of the invention having cone element 4 and conventional cone 5 slidably mounted on rod 2.

Figure 4:
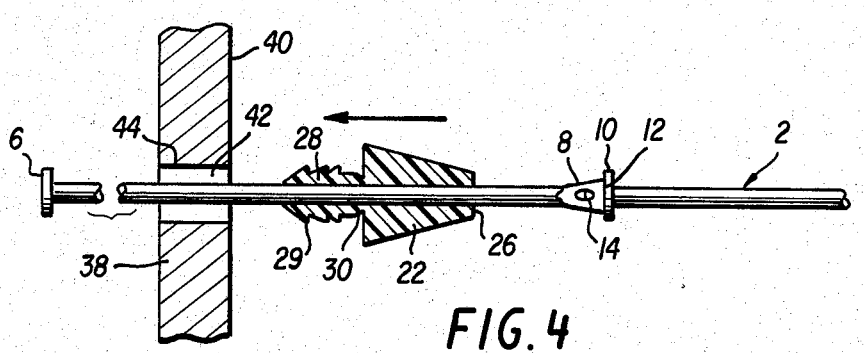
FIG. 4 is a side elevational view of the self-securing end of the tie rod being placed through an aperture in the form panel.
Figure 5:
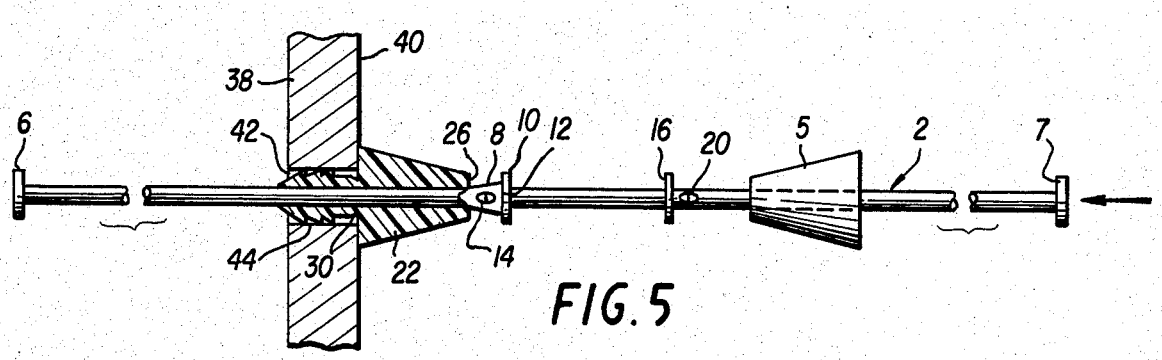
FIG. 5 is a side elevational view of the self-securing end of the tie rod partially secured to the form panel.
Figure 6:
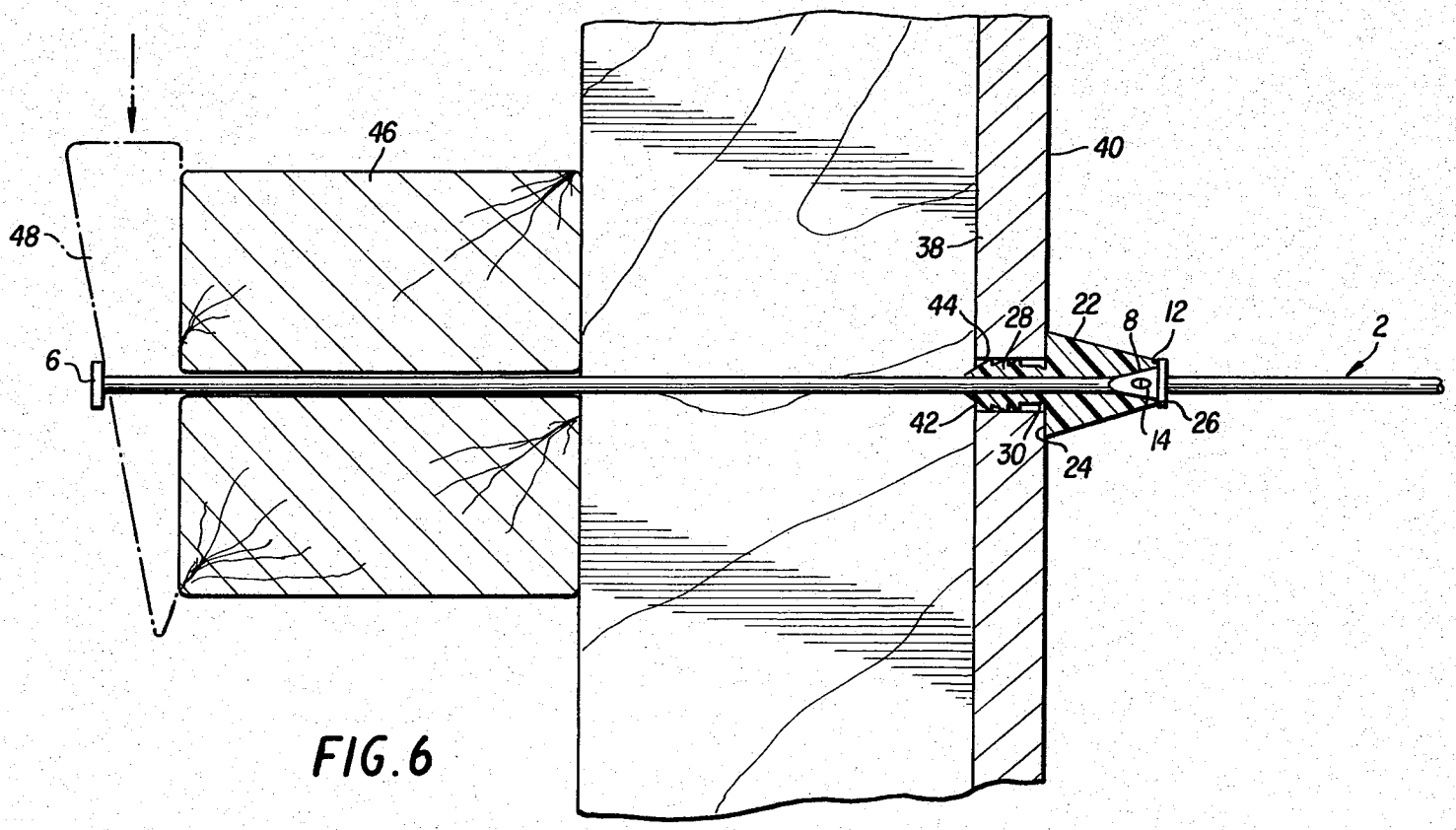
FIG. 6 is a side elevational view of the self-securing end of the tie rod secured against horizontal and vertical movement and attached to the conventional bracing system.

FIGS. 4, 5, 6 refer to the securing of the snap tie to panel 38 using the self securing end of the snap tie.

Referring to FIG. 4, it is to be understood the invention is used to space apart and secure a conventional form made from plywood or other suitable material which defines a space into which fresh concrete is poured. Panel 38 comprises one side of a conventional form described above. While only one side of the form is shown, it is understood the tie rod is used to space apart and secure a second parallel facing panel in conjunction with conventional cone 5 and abutment 16. Panel 38 has an interior wall 40 and an aperture 42 having an inner surface 44. Further, FIG. 4 shows rod 2 positioned perpendicular to panel 38 so that head 6 is aligned with (and prior to passage through) aperture 42 prior to its passage therethrough.

FIG. 5 shows dowel-like plug 28 after it has been forcefully engaged into aperture 42. Teeth 29 grip inner surface 44 to prevent vertical movement of the rod 2 relative to panel 38. Thereafter rod 2 is slidably projected by the striking of head 7 with a hammer or the like until, as shown in FIG. 6, wedge 8 is tightly and lockingly engaged into aperture 34 resulting in lip abutting end 26, and base 24 abutting interior wall 40 to prevent horizontal movement of rod 2 relative to panel 38.

It is understood that the invention is used in conjunction with a conventional form bracing system, including, as shown in FIG. 6, whaler bracket 46 and shoes 48.

After the concrete has been poured and cured the bracing system is removed and panel 38 is pulled off the hardened concrete. Coincident with the pulling motion described above the stripping snap point 30 will break, facilitating the removal of panel 38 if concrete seepage has penetrated the aperture 42. Thereafter the end portion of rod 2 is bent on a 90° angle and rotated in a circle like motion parallel to the face of the concrete wall causing rod snap point 14 to break, allowing extraction of the end portion of rod 2 and conical portion 22. The non-self securing end of the snap tie uses a conventional method for stripping of the opposite panel and extraction of conventional cone 5, such method incorporating use of snap point 20.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A self-securing tie rod used with panel forms for concrete construction including an elongated rod, securing means slidably mounted on said elongated rod, said securing means having gripping means, wherein said gripping means is a cylindrical extension having resilient irregularly shaped protrusions on an outer circumferential surface thereof for gripping a smooth interior wall of an aperture formed in a panel in a force-fit relationship therebetween to prevent undesired vertical movement of said elongated rod, and said elongated rod having formed thereon a wedge portion means for lockingly engaging said securing means to prevent undesired horizontal movement of said elongated rod.

2. The tie rod of claim 1 wherein said gripping means is a cylindrical extension having a reduced diameter on the end thereof to facilitate a snapping off of said cylindrical extension from the main body of said securing means.

3. The tie rod of claim 1 wherein said wedge portion located on said elongated rod has an indentation to facilitate a snapping of said elongated rod into two pieces.

4. The tie rod of claim 2 wherein said wedge portion located on said elongated rod has an indentation to facilitate a snapping of said elongated rod into two pieces.

5. The tie rod of claim 1 wherein a lip portion is formed on said wedge portion of said elongated rod for abutting one end of said securing means.

6. The tie rod of claim 2 wherein a lip portion is formed on said wedge portion of said elongated rod for abutting one end of said securing means.

7. The tie rod of claim 3 wherein a lip portion is formed on said wedge portion of said elongated rod for abutting one end of said securing means.

8. The tie rod of claim 4 wherein a lip portion is formed on said wedge portion of said elongated rod for abutting one end of said securing means.

* * * * *